US008764144B2

(12) United States Patent
Kim et al.

(10) Patent No.: US 8,764,144 B2
(45) Date of Patent: Jul. 1, 2014

(54) METHOD OF CONTROLLING NOZZLES OF INKJET HEAD AND APPARATUS FOR MEASURING AMOUNTS OF INK EJECTED FROM NOZZLES OF INKJET HEAD

(75) Inventors: Tae-gyun Kim, Suwon-si (KR); Tae-woon Cha, Seoul (KR); Sang-il Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 166 days.

(21) Appl. No.: 13/533,084

(22) Filed: Jun. 26, 2012

(65) Prior Publication Data

US 2012/0268508 A1 Oct. 25, 2012

Related U.S. Application Data

(62) Division of application No. 12/060,425, filed on Apr. 1, 2008, now Pat. No. 8,226,191.

(30) Foreign Application Priority Data

Feb. 1, 2008 (KR) ..... 2008-10815

(51) Int. Cl.
*B41J 29/38* (2006.01)

(52) U.S. Cl.
USPC ..... 347/10; 347/5; 347/6; 347/9; 347/14; 347/15; 347/19

(58) Field of Classification Search
USPC ..... 347/5–6, 9–10, 14–15, 19
See application file for complete search history.

(56) References Cited

U.S. PATENT DOCUMENTS

| | | | | |
|---|---|---|---|---|
| 4,788,466 | A * | 11/1988 | Paul et al. | 310/323.06 |
| 5,422,664 | A * | 6/1995 | Stephany | 347/14 |
| 6,278,469 | B1 * | 8/2001 | Bland et al. | 347/19 |
| 6,871,930 | B2 * | 3/2005 | Umetani et al. | 347/19 |
| 2003/0193539 | A1 * | 10/2003 | Umetani et al. | 347/19 |

FOREIGN PATENT DOCUMENTS

JP 2003-305831 10/2003

OTHER PUBLICATIONS

Korean Office Action dated Dec. 9, 2013 issued in KR Application No. 10-2008-0010815.

* cited by examiner

*Primary Examiner* — Ryan Lepisto
*Assistant Examiner* — Guy Anderson
(74) *Attorney, Agent, or Firm* — Stanzione & Kim, LLP

(57) ABSTRACT

Provided are method of controlling nozzles of an inkjet head and an apparatus for measuring the amounts of ink ejected from the nozzles of the inkjet head. The method includes: preparing a mass measuring device, which measures the mass of ink by using an oscillation change, in a pixel; ejecting ink into the pixel from a nozzle of the inkjet head, and measuring the amount of ink ejected from the nozzle by using the mass measuring device; and adjusting a voltage waveform applied to the nozzle of the inkjet head.

11 Claims, 5 Drawing Sheets

METHOD OF CONTROLLING NOZZLES OF INKJET HEAD AND APPARATUS FOR MEASURING AMOUNTS OF INK EJECTED FROM NOZZLES OF INKJET HEAD

CROSS-REFERENCE TO RELATED APPLICATIONS

This application is a Divisional Application of prior application Ser. No. 12/060,425, filed on Apr. 1, 2008 now U.S. Pat. No. 8,226,191, in the United States Patent and Trademark Office, which claims the benefit of Korean Patent Application No. 10-2008-0010815, filed on Feb. 1, 2008, in the Korean Intellectual Property Office, the disclosure of which is incorporated herein in its entirety by reference.

BACKGROUND OF THE INVENTION

1. Field of the Invention

The present invention relates to a method of controlling nozzles of an inkjet head, and more particularly, to an apparatus for measuring the amounts of ink ejected from nozzles of an inkjet head.

2. Description of the Related Art

In general, inkjet heads are devices that eject ink droplets onto desired positions of a recording medium through nozzles to form an image. Inkjet heads have recently been applied to various electronic devices such as liquid crystal displays (LCDs), organic light emitting displays (OLEDs), and organic thin film transistors (OTFTs).

FIG. 1 is a cross-sectional view for explaining a method of manufacturing a color filter for an LCD by using an inkjet head 50. Referring to FIG. 1, ink droplets 60 of predetermined colors are ejected through nozzles 55 of the inkjet head 50 and filled in pixels disposed on a substrate 10. Next, the ink is dried to form solid ink layers 65 in the pixels 22 to predetermined thicknesses. A black matrix 20 is formed on the substrate 20 and defines the pixels 22. In the manufacture of the color filter, the nozzles 55 of the inkjet head 50 may have different ejection characteristics such that different amounts of ink may be ejected through the nozzles 55. Accordingly, the ink layers 65 may be formed to different thicknesses in the pixels 22 as shown in FIG. 2, thereby causing significant degradation of color quality.

In order to uniformize the thicknesses of the ink layers 65, the same amount of ink should be ejected through all the nozzles 55 of the inkjet head 50 during a printing operation. To this end, it is necessary to control waveforms of voltages applied to the nozzles 55 of the inkjet head 50. Thus, various methods of controlling nozzles of an inkjet head have been suggested. For example, the masses of ink droplets ejected through the nozzles may be measured using a scale, such as a load cell. Alternatively, the volumes of ink droplets ejected through the nozzles may be measured using a camera. Alternatively, after ink droplets ejected through the nozzles are filled in pixels and dried, the thicknesses of ink layers formed in the pixels may be measured. However, the method of measuring the masses of the ink droplets using the scale may generate measurement errors and is time consuming. Also, the method of measuring the volumes of the ink droplets is difficult when the ink droplets have irregular shapes. Furthermore, since the method of measuring the thicknesses of the ink layers filled in the pixels involves a drying process, it takes much time to measure the thicknesses of the ink layers.q

SUMMARY OF THE INVENTION

The present invention provides an apparatus for measuring the amounts of ink ejected from nozzles of an inkjet head.

The present invention also provides a method of controlling nozzles of an inkjet head to eject the same amount of ink by using the apparatus.

According to an aspect of the present invention, there is provided a method of controlling nozzles of an inkjet head, the method comprising: preparing a mass measuring device, which measures the mass of ink by using an oscillation change, in a pixel; ejecting ink into the pixel from a nozzle of the inkjet head, and measuring the amount of ink ejected from the nozzle by using the mass measuring device; and adjusting a voltage waveform applied to the nozzle of the inkjet head.

The mass measuring device may comprise a first electrode, a piezoelectric material layer oscillating at a resonant frequency, and a second electrode which are sequentially stacked. The mass measuring device may include a quartz crystal microbalance (QCM). The mass measuring device may be disposed on a lower part of the pixel.

The amount of ink ejected from the inkjet head may be measured by using a frequency shift measured by the mass measuring device as the ink is filled in the pixel.

The measuring of the amount of ink ejected from the inkjet head may comprise: measuring a first resonant frequency before the ink is filled in the pixel by using the mass measuring device; measuring a second resonant frequency after the ink is filled in the pixel by using the mass measuring device; and calculating the mass of the ink filled in the pixel by using a frequency shift measured by the mass measuring device.

The adjusting of the voltage waveform applied to the nozzle may comprise: comparing the measured amount of ink ejected from the nozzle with a target amount of ink desired to be ejected from the nozzle; and applying a voltage waveform corresponding to the target amount of ink to the nozzle.

According to another aspect of the present invention, there is provided an apparatus for measuring the amount of ink, the apparatus comprising: a plurality of pixels in which ink ejected from nozzles of an inkjet head are filled; and mass measuring devices corresponding to the pixels and measuring the masses of ink filled in the pixels by using oscillation changes.

The pixels may be formed to correspond to the nozzles of the inkjet head.

The apparatus may further comprise a frame on which the pixels are formed. Edges of the mass measuring devices may be fixed to the frame.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
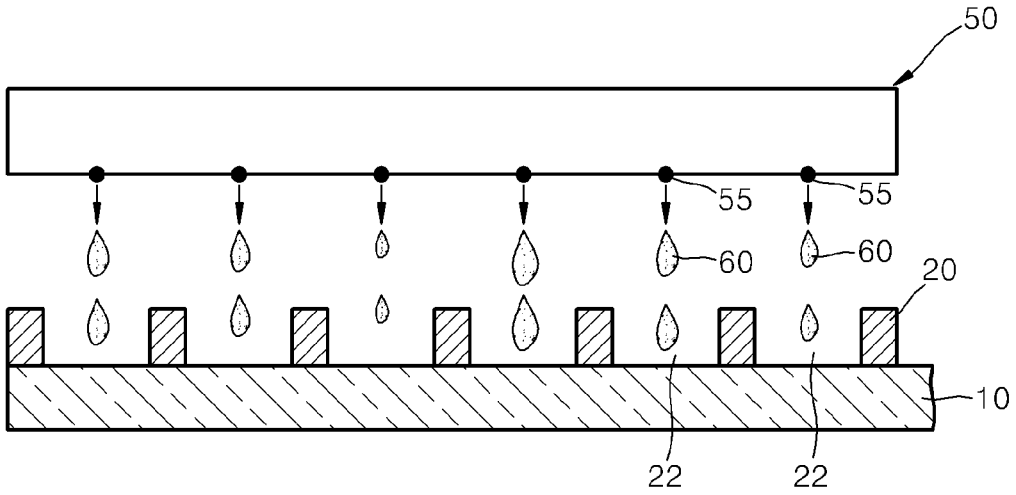
FIG. 1 (PRIOR ART)
FIG. 1 is a cross-sectional view for explaining a method of manufacturing a color filter for a liquid crystal display (LCD) by using an inkjet head.
Figure 2:
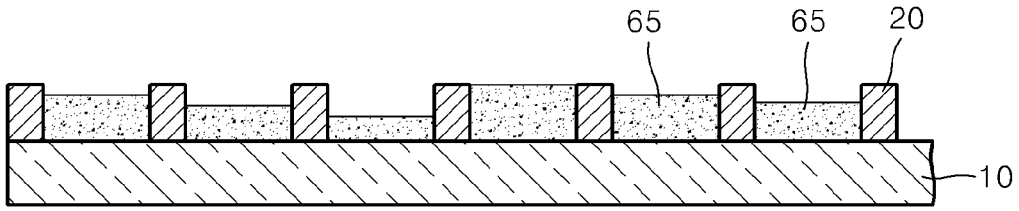
FIG. 2 (PRIOR ART)
FIG. 2 is a cross-sectional view illustrating ink layers formed in pixels to different thicknesses.

The present invention will now be described more fully with reference to the accompanying drawings, in which exemplary embodiments of the invention are shown. In the drawings, the same reference numerals denote the same elements and the sizes or thicknesses of elements may be exaggerated for clarity.

The present invention uses a mass measuring device, such as a quartz crystal microbalance (QCM), which can measure a micro mass change in order to measure the amount of ink filled in a pixel by inkjet printing.

Figure 3:
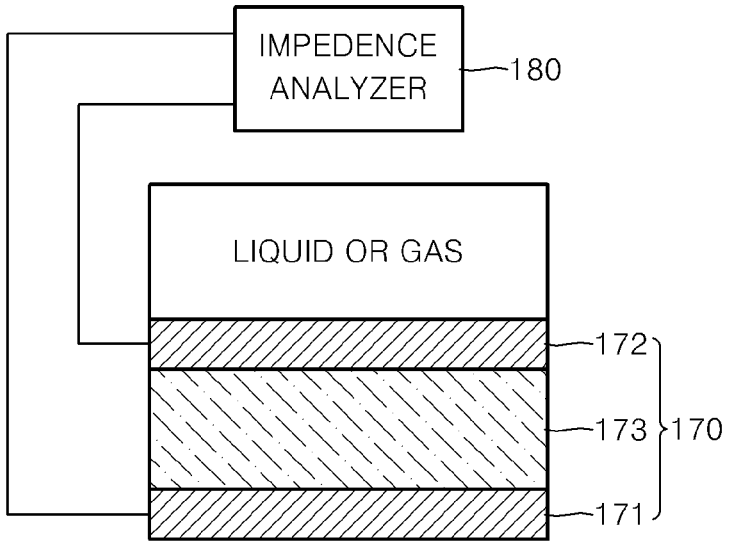
FIG. 3 is a cross-sectional view illustrating a quartz crystal microbalance (QCM)

FIG. 3 is a cross-sectional view of a QCM 170. Referring to FIG. 3, the QCM 170 includes a first electrode 171, a quartz crystal 173, and a second electrode 172 which are sequentially stacked. The first and second electrodes 171 and 172 may be formed of gold. The quartz crystal 173 is a piezoelectric material oscillating at a resonant frequency. An impedance analyzer 180 for measuring the impedance of the quartz crystal 173 is electrically connected to the first and second electrodes 171 and 172. The resonant frequency of the QCM 170 may be measured by using the impedance analyzer 180.

Figure 4:
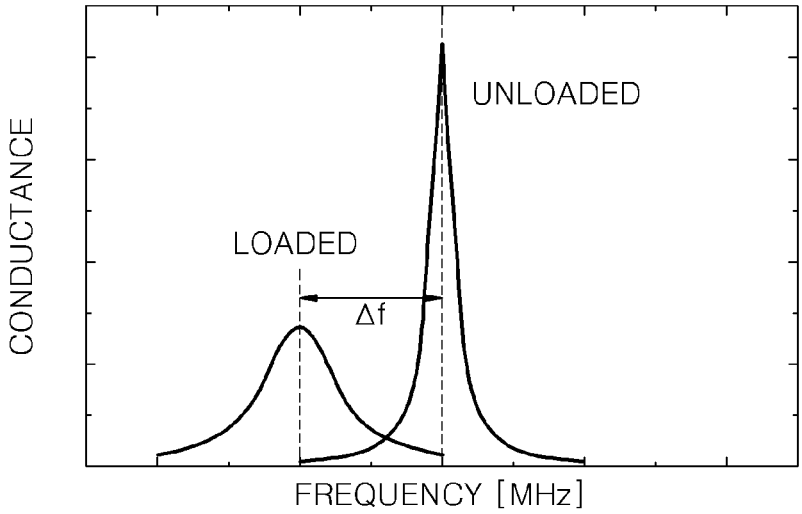
FIG. 4 is a graph illustrating mass versus frequency in a QCM.

In this structure, when a predetermined material, e.g., liquid or gas, is attached to the second electrode 172, the resonant frequency measured by the QCM 170 is shifted as shown in FIG. 4. FIG. 4 is a graph illustrating mass versus frequency in a QCM. Accordingly, the mass of the material attached to the second electrode 172 can be measured by using a measured frequency shift.

In detail, a frequency shift measured by the QCM 170 according to a mass change is given by $$\Delta f = -[2 \times fo2 \times \Delta m]/[A \times (\rho q \times \mu q)^{1/2}] \quad (1)$$

where Δf is the measured frequency shift, fo is the resonant frequency of the fundamental mode of the crystal, Δm is the mass change per unit area (g/cm2), A is a piezoelectrically active area, ρq is the density of quartz that is 2.648 g/cm3, and μq is the shear modulus of quartz that is 2.947×1011 g/cm×s2.

Referring to Equation 1, once the frequency shift Δf is calculated by measuring resonant frequencies by using the QCM 170 before and after a predetermined material is attached to the second electrode 172 of the QCM 170, the mass change Δm due to the material attached to the second electrode 172 of the QCM 170 can be calculated.

The QCM 170 is generally used to measure a change in the mass of a chemical material or the amount of material adsorbed to a biosensor. The first and second electrodes 171 and 172 may be formed of a conductive metal material other than gold. The first and second electrodes 171 and 172 may be surface-processed in order to prevent reaction with ink. The present invention measures a very small amount of ink ejected from a nozzle of an inkjet head in real time by using a mass measuring device, such as a QCM, which can measure a very small mass change according to a frequency shift.

Figure 5:
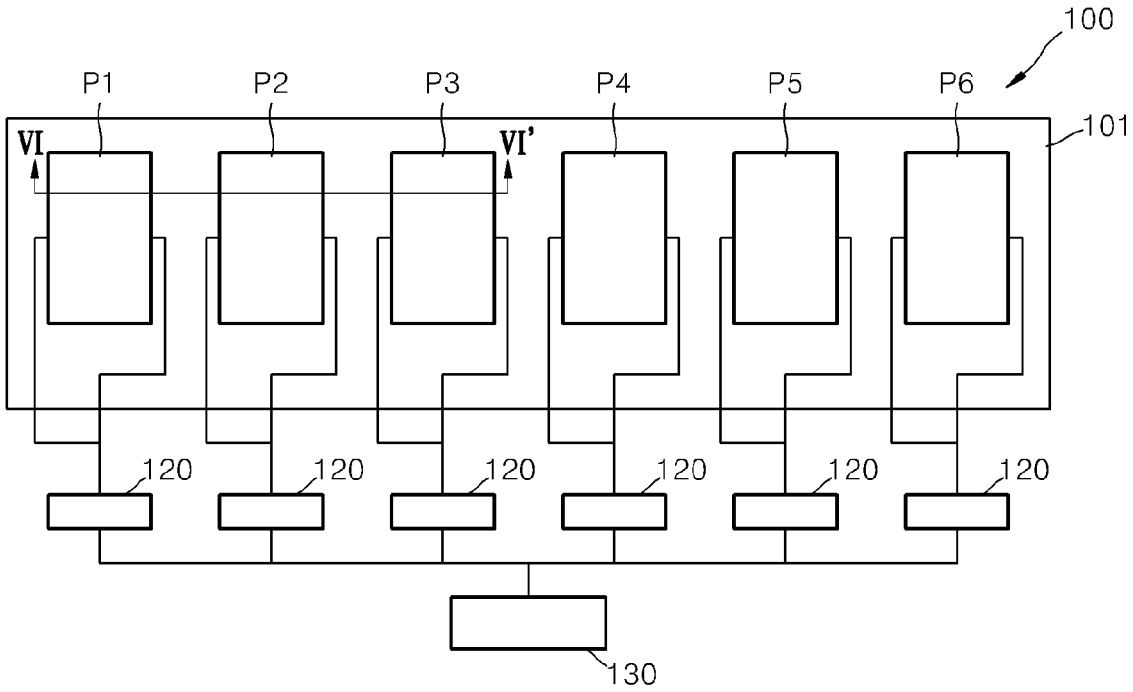
FIG. 5 is a plan view of an apparatus for measuring the amounts of ink ejected from nozzles of an inkjet head according to an embodiment of the present invention.
Figure 6:
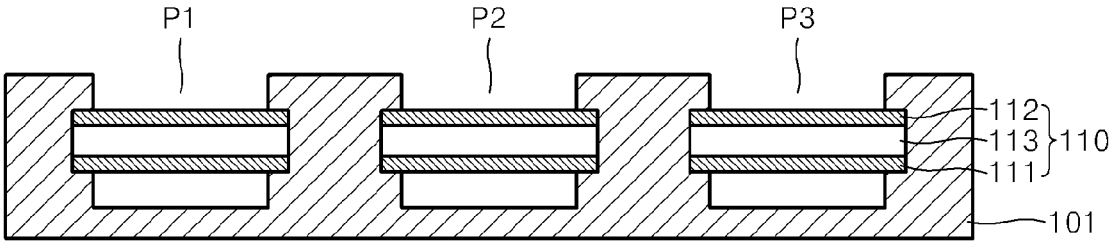
FIG. 6 is a cross-sectional view taken along line VI-VI' of FIG. 5.

FIG. 5 is a plan view of an apparatus 100 for measuring the amounts of ink ejected from nozzles of an inkjet head according to an embodiment of the present invention. FIG. 6 is a cross-sectional view taken along line VI-VI of FIG. 5.

Referring to FIGS. 5 and 6, the apparatus 100 includes a plurality of pixels P1 through P6 and mass measuring devices 110 corresponding to the pixels P1 through P10. In detail, the pixels P1 through P6 are formed in predetermined shapes on a frame 101. The mass measuring devices 110 are correspondingly disposed in the pixels P1 through P6. The frame 101 may be formed of a polymer resin such as polypropylene. However, the present invention is not limited thereto, and the frame 101 may be formed of various other materials. Ink ejected from nozzles N1 through N6 of an inkjet head 150 (see FIG. 7) is filled in the pixels P1 through P6 formed on the frame 101 as will be described later. Accordingly, the pixels P1 through P6 may be formed to correspond to the nozzles N1 through N6 of the inkjet head 150. Although the six pixels P1 through P6 are aligned on the frame 101 in FIG. 5, the present invention is not limited thereto and the number and arrangement of the pixels P1 through P6 may be modified. Although the pixels P1 through P6 have rectangular shapes in FIG. 5, the present invention is not limited thereto and the pixels P1 through P6 may have various other shapes.

The mass measuring devices 110 measure the amounts of ink ejected from the nozzles N1 through N6 corresponding to the pixels P1 through P6 by measuring the amounts of ink filled in the pixels P1 through P6. The mass measuring devices 110 measure the masses of ink filled in the pixels P1 through P6 by using an oscillation change like the aforesaid QCM. The mass measuring devices 110 are disposed on lower parts of the pixels P1 through P6 and measure the amounts of ink thereon. Each of the mass measuring devices 110 may be structured such that a first electrode 111, a piezoelectric material layer 113, and a second electrode 112 are sequentially stacked. The second electrode 112 may be surface-processed in order to prevent damage due to collisions between its surface and ink. The mass measuring device 110 may be a QCM, but the present invention is not limited thereto. That is, the piezoelectric material layer 113 may be formed of a quartz crystal, but the present invention is not limited thereto and the piezoelectric material layer 113 may be formed of any material that oscillates at a resonant frequency. The first and second electrodes 111 and 112 may be formed of gold, or other metal material with high conductivity. Since the mass measuring device 110 oscillates in a shear mode, an oscillation part of the mass measuring device 110 may be spaced apart from the frame 101. To this end, only an edge of the mass measuring device 110 may be fixed to the frame 101. The first and second electrodes 111 and 112 of the mass measuring devices 110 disposed in the pixels P1 through P6 are electrically connected to impedance analyzers 120. A measuring instrument is connected to the impedance analyzers 120 and measures the masses of ink filled in the pixels P1 through P6 by using frequency shifts measured by the impedance analyzers 120.

Figure 7:
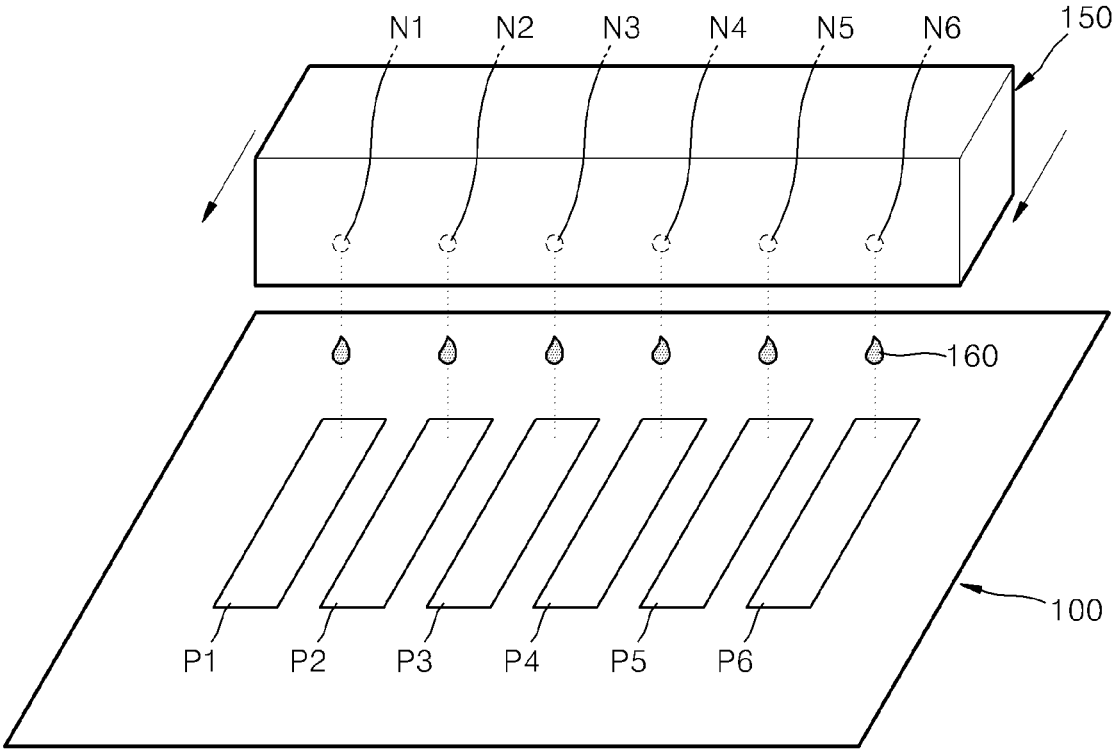
FIG. 7 is a perspective view illustrating pixels of the apparatus of FIG. 5 printed by the inkjet head according to an embodiment of the present invention.

FIG. 7 is a perspective view illustrating the pixels P1 through P6 of the apparatus 100 of FIG. 5 printed by the inkjet head 150 according to an embodiment of the present invention. Referring to FIG. 7, as the inkjet head 150 moves in an arrow direction, a predetermined number of ink droplets are ejected from each of the nozzles N1 through N6. The ejected ink droplets are respectively filled in the pixels P1 through P6 to form ink layers to predetermined thicknesses. As the ink is filled in the pixels P1 through P6, frequency shifts are measured by the mass measuring devices 110 disposed in the pixels P1 through P6. The masses of ink filled in the pixels P1 through P6 can be calculated by using the measured frequency shifts, and accordingly, the amounts of ink ejected from the nozzles N1 through N6 corresponding to the pixels P1 through P6 can be measured.

Figure 8:
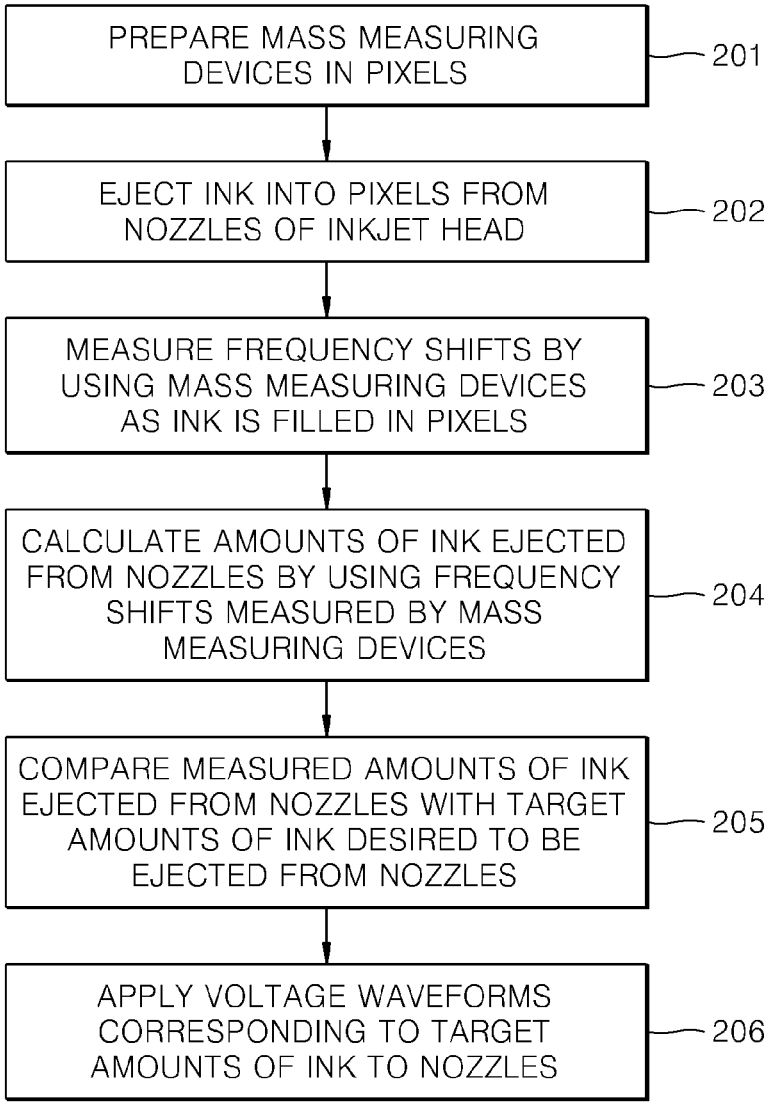
FIG. 8 is a flowchart illustrating a method of controlling nozzles of an inkjet head according to an embodiment of the present invention.

A method of controlling the nozzles N1 through N6 of the inkjet head 150 by using the apparatus 100 for measuring the amounts of ink ejected from the nozzles N1 through N6 of the inkjet head 150 will now be explained with reference to FIGS. 7 and 8. FIG. 8 is a flowchart illustrating a method of controlling the nozzles N1 through N6 of the inkjet head 150 according to an embodiment of the present invention.

Referring to FIGS. 7 and 8, the apparatus 100 of FIG. 5 is prepared. That is, in operation 201, the mass measuring devices 110 are disposed in the pixels P1 through P6. The mass measuring devices 110 have already been explained in detail, and thus an explanation thereof will not be given. In operation 202, ink is ejected into the pixels P1 through P6 from the nozzles N1 through N6 of the inkjet head 150. In detail, when predetermined voltage waveforms are applied to the nozzles N1 through N6 of the inkjet head 150, a predetermined number of ink droplets are ejected from each of the nozzles N1 through N6. The ejected ink droplets are filled in the pixels P1 through P6 corresponding to the nozzles N1 through N6.

In operation 203, frequency shifts are measured by the mass measuring devices 110 as the ink is filled in the pixels P1 through P6. In detail, first natural frequencies before the ink is filled in the pixels P1 through P6 are measured by the mass measuring devices 110 disposed in the pixels P1 through P6. Second natural frequencies after the ink is filled in the pixels P1 through P6 by inkjet printing are measured by the mass measuring devices 110. Accordingly, frequency shifts can be measured by the mass measuring devices 110 as the ink is filled in the pixels P1 through P6. In operation 204, the amounts of ink ejected from the nozzles N1 through N6 of the inkjet head 150 are measured. In detail, the masses of ink filled in the pixels P1 through P6 can be calculated by using the frequency shifts measured by the mass measuring devices 110. Accordingly, the amounts of ink ejected from the nozzles N1 through N6 corresponding to the pixels P1 through P6 can be measured.

In operation 205, the measured amounts of ink ejected from the nozzles N1 through N6 and target amounts of ink desired to be ejected from the nozzles N1 through N6 are compared with each other. The target amounts of ink may mean the amounts of ink necessary to form ink layers having uniform thicknesses in the pixels P1 through P6. In operation 206, voltage waveforms applied to the nozzles N1 through N6 are adjusted and voltage waveforms corresponding to the target amounts of ink are applied to the nozzles N1 through N6. When the adjusted voltage waveforms are applied to the nozzles N1 through N6, the same amount of ink can be ejected from the nozzles N1 through N6 of the inkjet head 150. Accordingly, when voltage waveforms adjusted in the above manner are applied to the nozzles N1 through N6 of the inkjet head 150 in order to manufacture a color filter, ink layers having uniform thicknesses can be formed in pixels of the color filter.

When the overall operations are repeated one or more times, the nozzles N1 through N6 of the inkjet head 150 can be controlled more accurately. That is, the nozzles N1 through N6 can be more accurately controlled by applying the adjusted voltage waveforms to the nozzles N1 through N6, measuring the amounts of ink filled in the pixels P1 through P, comparing the measured amounts of ink with target amounts of ink, and adjusting again voltage waveforms applied to the nozzles P1 through P6.

As described above, the present invention can measure the amounts of ink ejected from the nozzles of the inkjet head by using the mass measuring devices that can measure very small masses of ink. The present invention can eject the same amount of ink from the nozzles of the inkjet head by adjusting voltage waveforms applied to the nozzles of the inkjet head by using the measured amounts of ink. Accordingly, the present invention can form ink layers having uniform thicknesses in the pixels. Accordingly, when the pixels of the apparatus for measuring the amounts of ink according to the present invention are arranged in the same pattern as that of a color filter, a color filter including ink layers having uniform thicknesses in pixels can be formed. Also, even when liquid ink is filled in the pixels and solvent is evaporated, the present invention can monitor the amounts of ink in the pixels in real time. That is, although a conventional apparatus can measure the amounts of ink after ink is filled in pixels and then a post-treatment, such as baking, is performed, the present invention can measure the amounts of ink at the same time when the ink is filled in the pixels, thereby considerably reducing a measurement time. Moreover, since the apparatus for measuring the amounts of ink according to the present invention can be re-used after washing, expenses can reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus to measure an amount of ink, the apparatus comprising:

a plurality of pixels formed within the apparatus in which ink ejected from nozzles of an inkjet head are filled;

a frame on which the pixels are formed; and mass measuring devices corresponding to the pixels and disposed within the pixels to measure the masses of ink filled in the pixels by using oscillation changes.

2. The apparatus of claim 1, wherein each of the mass measuring devices comprises a first electrode, a piezoelectric material layer oscillating at a resonant frequency, and a second electrode which are sequentially stacked.

3. The apparatus of claim 2, wherein the mass measuring device includes a QCM.

4. The apparatus of claim 1, wherein the mass measuring devices are disposed on lower parts of the pixels.

5. The apparatus of claim 1, wherein the mass measuring devices measure the masses of ink filled in the pixels by using frequency shifts measured as the ink is filled in the pixels.

6. The apparatus of claim 1, wherein the pixels are formed to correspond to the nozzles of the inkjet head.

7. The apparatus of claim 1, wherein edges of the mass measuring devices are fixed to the frame.

8. An apparatus to measure an amount of ink, the apparatus comprising:

a plurality of pixels formed within the apparatus and corresponding to respective nozzles of an inkjet head to receive ink from the respective nozzles;

a frame on which the pixels are formed; and a plurality of mass measuring devices disposed within the respective pixels to measure the masses of the ink by measuring frequency shifts in the mass measuring devices simultaneously as the ink is filled in the respective pixels.

9. The apparatus of claim 8, wherein each of the mass measuring devices comprises:

a piezoelectric material layer oscillating at a resonant frequency;

a first electrode located on one side of the piezoelectric material layer; and a second electrode located on another side of the piezoelectric material layer, wherein the resonant frequency shifts according to a mass of a material attached to the second electrode.

10. The apparatus of claim 9, wherein the piezoelectric material layer includes a quartz crystal.

11. The apparatus of claim 10, wherein each of the frequency shifts is calculated by:

$$\Delta f=-[2\times f_o^2\times\Delta m]/[A\times(\rho_q\times\mu_q)^{1/2}],$$

wherein $\Delta f$ is a measured frequency shift, $f_o$ is a resonant frequency of a fundamental mode of the quartz crystal, $\Delta m$ is a mass change per unit area ($g/cm^2$), A is a piezoelectrically active area, $\rho_q$ is a density of the quartz crystal that is 2.648 $g/cm^3$, and $\mu_q$ is a shear modulus of the quartz crystal that is $2.947\times10^{11}$ $g/cm\times s^2$.

* * * * *